United States Patent [19]

Horst et al.

[11] Patent Number: 4,665,969

[45] Date of Patent: May 19, 1987

[54] CONTINUOUS CASTING APPARATUS

[75] Inventors: Hans Horst, Casilla 9238; Werner S. Horst, both of Santiago de Chile; Bernardo P. Muellers, Valparaiso, all of Chile

[73] Assignee: Hans Horst, Santiago de Chile, Chile

[21] Appl. No.: 722,379

[22] Filed: Apr. 12, 1985

[30] Foreign Application Priority Data

Apr. 13, 1984 [DE] Fed. Rep. of Germany ..... 3414066
Aug. 29, 1984 [DE] Fed. Rep. of Germany ..... 3431622

[51] Int. Cl.[4] ..... B22D 11/10
[52] U.S. Cl. ..... 164/439; 164/443
[58] Field of Search ..... 164/72, 472, 488, 418, 164/439, 485, 436, 342, 454, 443

[56] References Cited

U.S. PATENT DOCUMENTS

| | | | |
|---|---|---|---|
| 2,126,808 | 8/1938 | Phillip | 164/418 |
| 3,093,503 | 6/1963 | Laszlo . | |
| 3,204,460 | 9/1965 | Milnes | 164/418 |
| 3,353,584 | 11/1967 | Atkin | 164/439 |
| 3,645,767 | 2/1972 | Taylor | 164/472 |
| 3,780,789 | 12/1973 | Unger | 164/439 |
| 3,937,269 | 2/1976 | Salvadore | 164/472 |
| 4,183,394 | 1/1980 | Viessmann | 164/440 |
| 4,202,523 | 5/1980 | Radtke | 164/72 |
| 4,456,054 | 6/1984 | Henders | 164/454 |
| 4,523,624 | 6/1985 | Dantzig | 164/454 |

FOREIGN PATENT DOCUMENTS

| | | | |
|---|---|---|---|
| 1854884 | 7/1962 | Fed. Rep. of Germany . | |
| 2047041 | 4/1971 | Fed. Rep. of Germany | 164/72 |
| 2058051 | 9/1971 | Fed. Rep. of Germany . | |
| 2409820 | 9/1975 | Fed. Rep. of Germany . | |
| 2856472 | 5/1980 | Fed. Rep. of Germany . | |
| 3215689 | 11/1982 | Fed. Rep. of Germany . | |
| 880615 | 11/1981 | U.S.S.R. | 164/418 |

*Primary Examiner*—Nicholas P. Godici
*Assistant Examiner*—G. M. Reid
*Attorney, Agent, or Firm*—Orrin M. Haugen; Thomas J. Nikolai; Frederick W. Niebuhr

[57] ABSTRACT

A continuous casting contrivance comprises a mold (*7a*) capable of being installed at the floor of the crucible (1) in an opening (3) that may, if necessary, display a casting punch (25*a*). Further provided for the mold is a cooling arrangement. As to whether the production and operating costs of a continuous casting contrivance of this type are to be significantly reduced as compared to the state of the art and the quality of the casting improved, and to be able to again prepare a mold for a renewed continuous casting, is provided for on the one hand by splitting the continuous casting mold (*7a*) into, if necessary, a supply part (4) accommodating the casting punch (25*a*) and, transversally to the direction of continuous casting, a cooling mold (7) capable of being regulated in its temperature, whereby the supply part (4) is disposed in the crucible floor (1) and/or in an insert (1*a*) provided there. The supply part (4) here consists of fire resistant and low heat conducting material, while the cooling mold (7) consists of, as the basic material, metal, preferentially a cast body (10). Achieved by the configuration, in accordance with the invention, of the cooling mold (7) with the encircling cooling tubes (9) cast in the shrink seat and with the casting material already provided with a sliding agent for the cooling mold (7) and/or the internally located cooling tube (13), are surprisingly improved casting results with reduced mold costs (FIG. 2).

17 Claims, 8 Drawing Figures

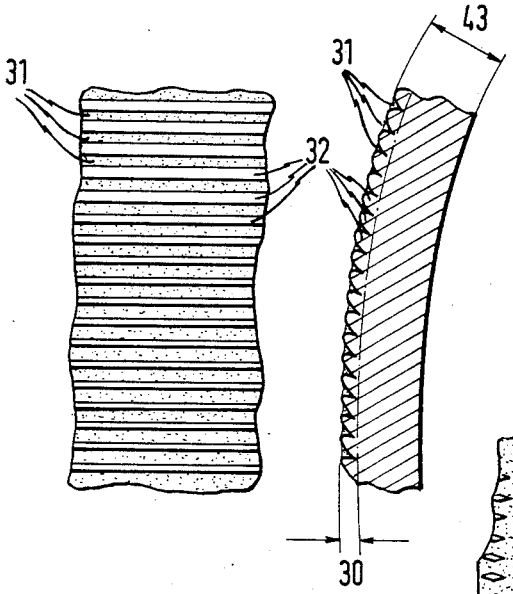
FIG. 3
FIG. 4
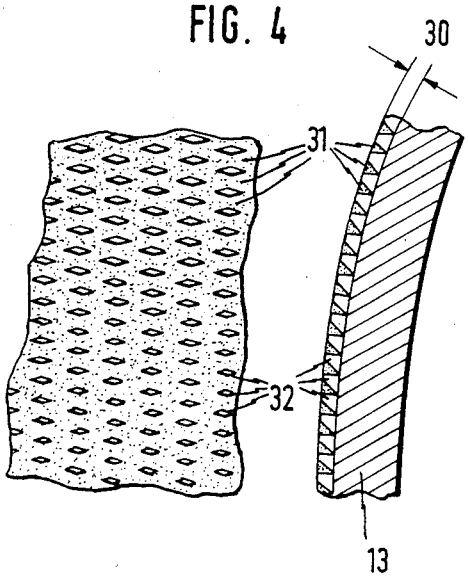
FIG. 5
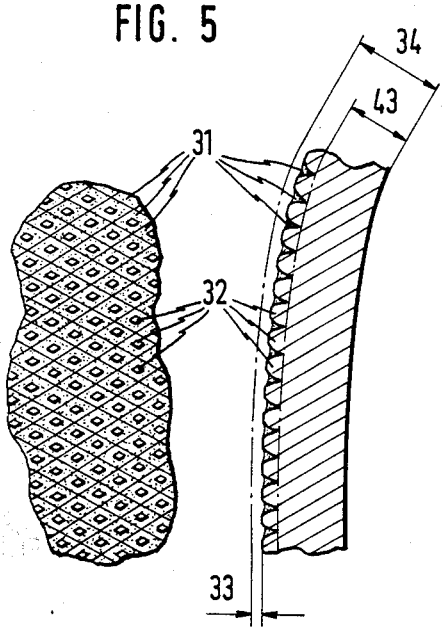
FIG. 6
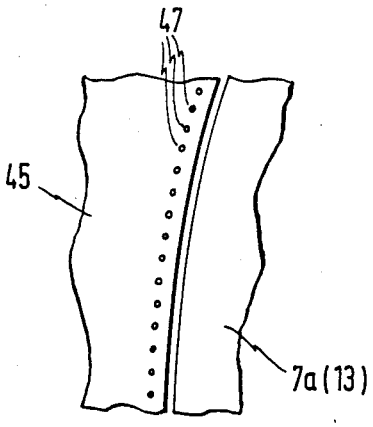

CONTINUOUS CASTING APPARATUS

BACKGROUND OF THE INVENTION

This invention concerns a continuous casting contrivance along with a process for its production.

Conventional cooling forms for continuous castings require molds that are costly, compression molded and consisting of electrographite, and become ever more expensive as a function of the continually rising costs for energy, since each mold must be newly produced as a precision rotating part for each casting.

The graphite molds used for the continuous casting processes employed today project upwardly into the heat retaining crucible or oven, with their cooling parts contained in a metal cooler. Up until the present time, molds almost exclusively have been graphite, since this material is the only one possessing the characteristics desirable and required for continuous casting processes. Such characteristics include non-wettability and non-solubility of the graphite through the metal to be cast, durability of the form at the casting temperature, relatively good heat conductance, and self-lubricating and parting characteristics, respectively.

However, graphite molds also have a disadvantage. The graphite material is not resistant to oxidation in the range above 550° C., frequently has defects, flaws, cracks, etc., and is very sensitive to frictional stress by the hard casting shell. This results in formation of grooves that impair the surface quality of the castings during continuous casting. Furthermore, graphite molds are very sensitive to impact, bending and tensional stressing.

The casting capacity of a graphite mold is dependent on the sizes occassioned by the material properties, and the heat flow through the wall of the mold. In order to raise the casting capacity one often uses as small a mold wall thickness as possible. However, large and thin-walled hollow cylindrical molds become very friable (brittle) and are then not safe. Even small transverse forces or a hard touchdown of the mold can lead to cracks or ruptures often not noticed prior to casting, and prone to cause serious and dangerous accidents, namely breakthroughs or so-called runouts.

A further serious disadvantage of the mold consisting of graphite is, in addition to the high costs for materials, the fact that much expert knowledge, care and time are required in the production of a graphite mold. Further needs are expensive tools, special suction-removal means, etc. Each mold must be precisely fitted, ground in or pressed into the metal cooler surrounding it in order to guarantee an adequate heat transfer. Very seldom is one adapter the same as another and often it is also precisely the large, thin-walled molds that break when knocked out of the metal cooler, because of the required, high degree of frictional adherence.

Additionally, problems frequently occur in production with material defects. One defect is warping of the cooler surrounding the graphite mold, even though used only a relatively short period of time. The cooler bulges out from uncontrolled heat stressing, to form an air gap between the mold outer wall and cooler that strongly reduces the cooling capacity and, therewith, casting capacity.

Finally, mold wear is a principal factor in production costs. On the average, the proportional costs for mold costs presently lie at 0.10 German Marks per kg of generated casting.

Disclosed in DE-OS 20 58 51 and DE-GM 18 54 884, is a mold that is split, in the longitudinal direction, into two or three parts, the overall structural length of the mold being relatively great because of the different casting conditions. In the first mold section, only slight heat need be removed below the floor of the melt crucible. A greater proportion of heat must be removed in the adjoining section. These types of molds have not proven effective and, when not using graphite, yield defective casting results.

SUMMARY OF THE INVENTION

An object of the invention is to overcome the disadvantages of the state of the art and to obtain a continuous casting contrivance as well as a process for its production whereby the production costs for the mold are significantly minimized, the time and expense for construction reduced, and the quality of the cast products is improved, e.g. as to holding to dimensions, surface quality and physical characteristics. The object is achieved by the invention in accordance with the claims.

A continuous casting apparatus in accordance with the present invention achieves remarkable technical progress, to be characterized as completely astonishing. By means of the present invention, metals and metal alloys can be continuously cast in optimum fashion by structuring the mold in split fashion and by heat-isolating the top supply part from the cooling part in the direction of casting transport. Another feature of the invention resides in the construction of the cooling surfaces and the geometric form of the mold, as well as independent temperature control.

As was obtained in experiments, the castings produced with the continuous casting contrivance in accordance with the invention display a most finely corrugated, uniform, dull-finish surface without the longitudinal grooves that otherwise appear in the rising mass in the case of massive graphite molds after substantial casting time.

According to a particularly preferred embodiment, a separate cooling tube inside the cooling mold body contains the graphite encircling parting agent, resulting in further simplified construction conditions with optimal continuous casting capabilities.

Improved cooling conditions without disadvantageous effects from heat stressing are realized in accordance with an inner cooling tube and the casting body fit to the cooling mold via a shrink connection.

Particularly short structural lengths can be realized by the use of appropriate gaskets.

Due to the increasing distance of the cooling coil from the inner cooling jacket, given the continually rising cooling agent temperature in the cooling coil, from the inlet side to the outlet side, the wall temperature of the cooling part of the mold rises in analogous fashion from the casting outlet side to the casting inlet side. Further, the distance between adjacent turns of the coil increases from the bottom to the top of the coil.

By using the graphitically separated carbon as well as the dispersed parting agent, graphite costs are substantially reduced, and outstanding sliding and casting characteristics are achieved, with the simplest embodiment of the cooling mold.

The cooling mold or cooling tube can be further machined at the surface, and additionally provided with a graphite encircling parting agent.

BRIEF DESCRIPTION OF THE DRAWINGS

FIGS. 3 to 5 are partial top views of the internal surface of the cooling mold and of the internally located tube, respectively, and an associated representation in a vertical cut;

FIG. 6 is a schematic representation in a cut of a hollow body for the purpose of surface treatment;

DESCRIPTION OF THE PREFERRED EMBODIMENT

Figure 1:
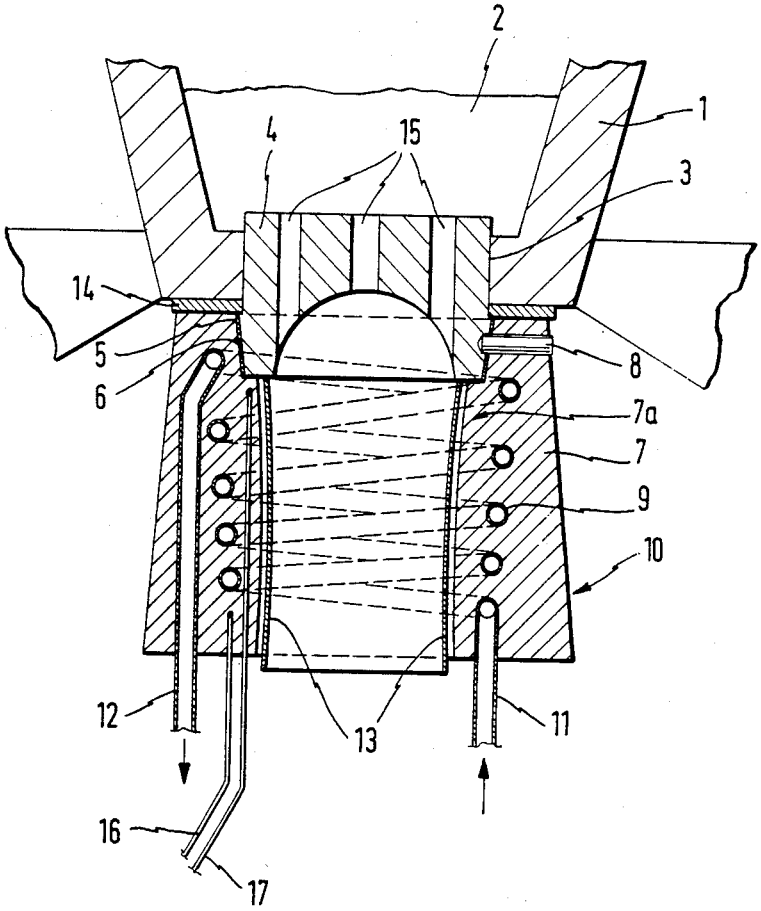
FIG. 1 is a first schematic representation in a vertical cut of a continuous casting contrivance in accordance with the invention.

FIG. 1 shows a bottom part of a heat retaining crucible or oven 1 in which is located a melt 2. Fitted into a boring 3, in the crucible or oven 1, is a supply or inlet part 4 of a continuous casting mold 7*a* suitable for continuous casting of solid profiles. Supply part 4 consists of a low heat conducting, fire resistant material that is not noticably attacked or wetted by the melt. Channels 15 are formed in part 4, through which the fluid melt arrives in the cooling part of the cooling part or mold 7. The inlet part 4 of the continuous casting mold 7*a* is joined with the cooling mold 7 by means of known structural elements, as for example a conical or cylindrical seat 5 and fitting pins 8, or with a suitable conical or cylindrical thread, with isolating gaskets 6 for sealing the fluid melt further being provided.

The cooling part 7 of the mold consists of a cast body 10 made of highly heat conductive material that includes cooling coils 9 and an internally located cooling tube 13 made of highly heat conductive, high strength metal, secured by a shrink connection. The cooling tube has the form of a rotation-paraboloid and has a surface suitable for the process, as it can be seen from FIGS. 3, 4 and 5. The inner surface of the cooling mold 7 and of the internally located tube 13 are paraboloid shaped and determined by the resulting curves of speed of removal and shrinkage of the continuous casting.

Figure 2:
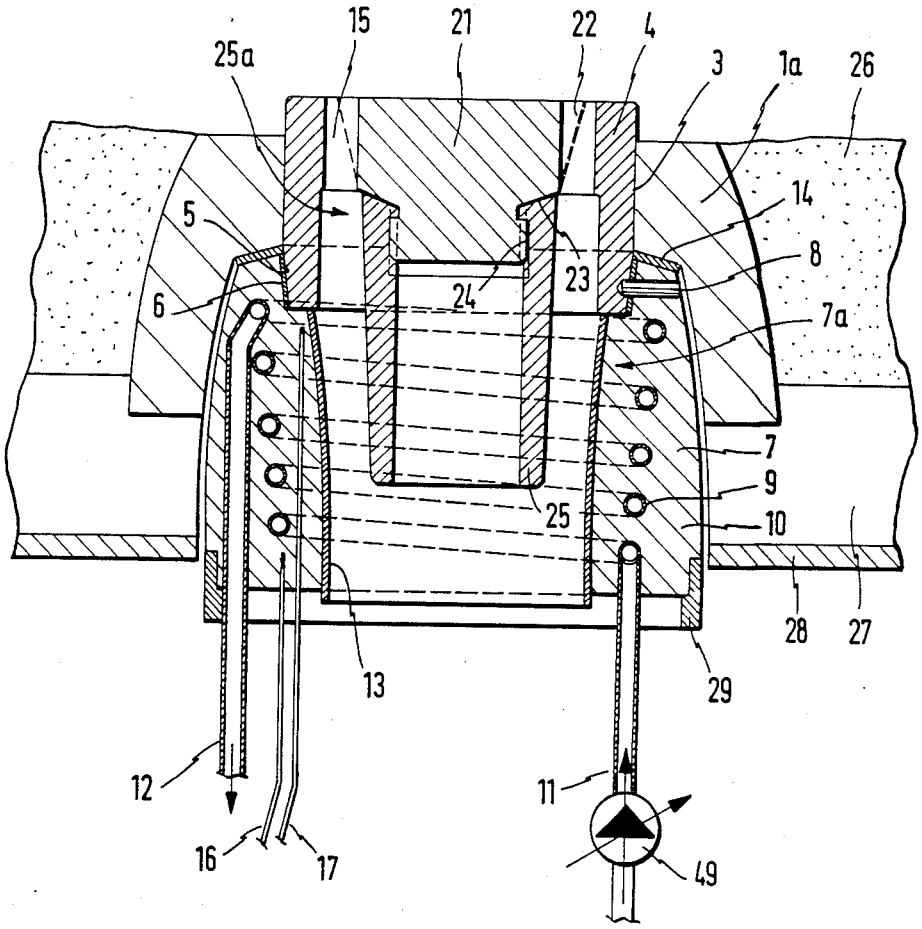
FIG. 2 is a second, schematic representation in a vertical cut of a second embodiment continuous casting contrivance in accordance with the invention.

A cooling agent inlet and a cooling agent outlet, respectively, are designated as 11 and 12. Isolating gaskets between the crucible and the top part of the cooling mold 7 are designated with 14. Thermal pairs 16 and 17 are provided in cast body 10, by which the temperature at the inlet and the outlet ends of the cooling mold 7 can be measured, to permit cooling agent temperature and quantity to be adjusted. Particulars of the crucible along with its isolation are not shown in detail since these are of no importance for the invention. Reference is made to FIG. 2 in which another embodiment of a continuous casting system in accordance with the invention is shown, primarily suited for casting larger hollow cross-sections and/or hollow profiles.

The supply part 4 of the continuous casting mold 7*a* is located in the opening or boring 3 of a highly fire resistant insert 1*a* of the oven floor 26, which is heat-dammed by a layer of insulation 27 against the lower part 28 of the steel construction of the oven floor. The supply part 4, like that in FIG. 1, is provided with a conical seat 5 and fitting pins 8, and isolated and sealed against the cooling part or mold 7 by gaskets. An isolating seal 14 separates the boring 3 from the cooling part 7 of the mold 7*a*. The supply part 4 consists of low heat conducting material that is not wetted by the melt and accommodates, through a precisely middle-centered element, e.g. a conical thread 22, the fire resistant insert 21. Attached to insert 21, by means of a thread 24 and the centering piece 23, is a hollow casting punch 25*a*.

Punch 25*a* can consist of highly fire resistant, low heat conducting material, with its surface being specially prepared for accommodating a parting agent as later explained. Alternatively, this hollow casting punch 25*a* can consist of a highly fire resistant, non-wettable material having self-lubricating and/or parting characteristics, the heat expansion of which is equal to or greater than that of the insert 21.

Therefore, as is seen from FIG. 2, the casting punch 25*a*, like the mold 7*a*, is constructed in two parts and comprises the top insert 21 and the lower part 25 attached thereunder.

The remaining elements are constructed in similar fashion to those in FIG. 1 and have corresponding reference numbers.

In order now to achieve a comprehensive sliding and parting action, with still further simplified construction and simplified production of the cooling mold and of the internally located cooling tube, cooling mold 7 (or an internally located cooling tube 13) is produced of an iron or copper alloy with integeral, finely distributed parting agent in a solid body dispersion. Particularly suited for this purpose are iron alloys with the addition of carbon, for example an iron alloy with 2 to 3.2% C, 0.4 to 2.2% Si and 15 to 25% Cr. In this alloy, the carbon is present as finely-laminar graphite in a perlitic basic mass to form a heat resistant gray metal casting, with, in addition to graphically separated carbon, graphite crystals in uniformly, finely distributed form. In particular for smaller casting cross sections with a diameter of preferentially less than 50 cm, the internally located cooling tube 13 consists of a thin walled, stainless steel or of aluminum-bronze.

Demonstrating themselves to be particularly favorable have also been the austenitic types of cast iron with a preferentially laminar graphite layer. In particular, the gray cast iron alloys (DIN 1694):

GCIA (Gray Cast Iron Alloy)—Ni Cu Cr (1562) with a proportion of 3.0% C, 1.0 to 2.8% Si, 1.0 to 1.5 Mn, 13.5 to 17.5% Ni, 1.5 to 2.5% Cr, 5.5 to 7.5% Cu, respectively.

GCIA—Ni Cu Cr (1563) with an identical composition as in the preceding, however, with a chromium content of 2.5 to 3.5%, whereby is obtained a higher corrosion resistance and/or erosion resistance, respectively.

GCIA—Ni Cr (202), with equal cooper, silicon and manganese content whereby, however, deviating, the nickel content amounts to 18 to 22% and the chromium content amounts to 1 to 2.5%.

Particularly preferred is the parting agent present in the cooling tube (or in the cooling mold 7) in grain sizes between 0.01 and 0.5 mm, and finally, predominantly or statistically preferentially, with its preferred sliding plane oriented parallel to the longitudinal axis of the internally located cooling tube or cooling mold.

Construction of a cooling mold or tube of this type will be explained in more detail in the following with the aid of FIGS. 7 and 8.

Figure 7:
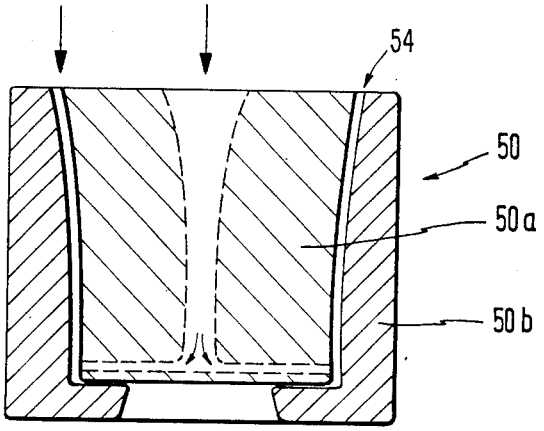
FIG. 7 is a representation in a cut through a form body for producing a cooling tube.
Figure 8:
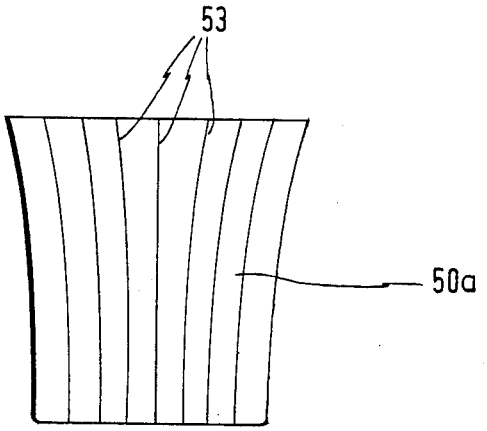
FIG. 8 is an elevation showing the surface of the inner body form.

Shown in FIG. 7 in a vertical cut is a heat-resistant form body 50 with an internally located form body half 50*a* and an external form body half 50*b*.

The arrangement is such that the two form halves 50*a* and 50*b* can be rotated relative to each other, for example such that the inner form body half 50*a* rotates, while the outer form body half 50*b* remains stationary. The rotating form body half, in the example of the embodiment shown the inner one, is further provided with vertical ribs 53 as shown in FIG. 8, whereby slightly wedge-shaped intermediate spaces remain, the importance of which will be explained.

In the space 54 between the two form body halves, an appropriate alloy is cast for making cooling tube 13. The alloy has a temperature above the liquifying line, preferentially a temperature that is only slightly above liquifying line. The parting agent is then added, under continual rotation, to at least one form body half, in the example of embodiment shown the inner form body half 50*a*. A powder-form parting agent is preferred, in particular graphite, with the grain spectrum lying at least 70% between 0.1 to 0.5 mm. Also, additives of preferentially high melting point carbonates, exides and nitrides can be admixed to the sliding agent as a function of the metal and/or metal alloy to be cast. During rotation the temperature is dropped below the liquifying line. Resulting from the rotation is a uniform distribution of the parting agent since the broth-fluid alloy is carried in particular through the ribs 53 of the inner form body half 50*a*. Further, the centrifugal forces cause the lighter parting agent components to diffuse inwardly, and come to rest with a higher density on the internally located surface of the cooling tube 13. In the same manner, the density of the parting agent parts, with low specific weight, increases from the bottom toward the top because of the force of gravity. The thixotropic behavior—in similar fashion to a sludge—of the undercooled alloy reduces the separation by upward thrust and centrifugal force.

A further advantage, is that, because of the denser addition of parting agent body on the internally located surface of the cooling mold, the sliding and parting characteristics are improved. Here, the position, the distribution and orientation of the sliding agent particles, for example graphite crystals, can be controlled within wide ranges by appropriate, optimal selection of the temperature, the speed of rotation, and cooling intensity.

By means of the ribs, there is formed an improved and increased heat transfer surface for achieving a shrink connection. If the outer form body half 50*b* is also correspondingly isolated or heated, a slow cooling down of the melt is achieved. Since the parting agent displays an essentially lower heat expansion than the surrounding metal alloy, the sliding and parting agent particles, when cooling down along with the metal alloy, are firmly shrunken about by this latter.

As shown in FIG. 7, pouring into the rotating casting form (form body 50) can also be accomplished from top toward the bottom through a partially hollow, internally located form body 50*a*, that simultaneously serves, in its lower part, as a brake core and ejector. After hardening, cooling tube 13 is shrunken onto its fire resistant jacket. Then, the hollow core serving as the inner form body 50*a* is pushed off of the cooling tube 13. Because of the shrinking process, particularly in the case of larger dimensions, the hollow core is usually destroyed, this hollow core for example consisting of grains of sand bound with furan epoxy, of clay/graphite and e.g. alumina compounds.

As an alternative, the parting agent, which consists essentially of graphite, can also be added beforehand in the fluid iron or, for example, the copper alloy with a temperature above the liquifying line prior to casting into the form body.

According to the process of construction, therefore, the parting agent can be added at a higher concentration internally at the cooling mold and/or at the cooling tube so that adequate sliding characteristics can be achieved. These can partially be improved further by etching the internally located surface of the cooling mold 7 and/or of the cooling tube 13, whereby, portions of graphite can come forth in raised fashion from the perlitic basic mass. Further surface treatment is also possible and oftentimes practical.

Reference is made to FIGS. 3 to 5 that respresent greatly magnified sections (about 10:1) of the process-typical surfaces of the cooling areas of the mold (or of the internally located cooling tube 13) which, after processing and coating, appear in the casting-ready condition. (The hollow part 25 of the casting punch 25*a* can also be provided with this surface).

FIG. 3 illustrates a process-typical surface prepared in accordance with the invention by means of the cut of a multiple-pass saw or serrated thread, with a lesser pitch, after smoothing and adding the parting layer, enlarged 10 times.

Illustrated here with 43 is the strength and/or thickness of the shrunken in cooling tube 13 and with reference number 30 the depth of the thread pass after the smoothing process, in particular grinding. Designated with 31 are the valleys that are fully pressed with the parting agent, while with 32 are illustrated the raised, ground down thread crests. In the case of all three enlarged illustrations, the counter-conicity appears to be strongly exaggerated by the form of the rotation-paraboloid in accordance with the invention.

Shown in FIG. 4 with the reference number 13 is the internally located cooling tube with the crosswise (left and right) cut saw threads, with about a 15° inclination. Here, the area 31 filled with the parting agent by far preponderates the surface, the remainder being pyramid stumps 32 whose flanks become more and more rounded by the constructional grinding and polishing step, by the subsequent chrome hardening, and wear, until a stable condition is reached.

FIG. 5 illustrates a casting-ready surface as results from knurling. Here, specified with 43 is again the thickness of the internally located mold tube, which, depending upon the initial diameter and the alloy to be cast, lies between 3.5 and 16 mm.

Specified with 34 is the original wall thickness of this internally located tube prior to smoothing the crests, and with 33 the surface layer removed by he smoothing process. The reference number 32 identifies the remaining cone stumps, and reference number 31 the cooling surface covered by the parting agent. The regulation of the cooling agent quantity can be undertaken based on the principle of differential control by means of thermo-elements that are cast in one each at the casting inlet and outlet side such that the speed of casting is controlled and optimized exclusively based on the casting outlet temperature.

Particularly suited as a cooling agent is soft water that is supplied through the quantity-adjustable feed pump, under pressure, to the cooling coils of the mold, as a function of temperature difference—as explained precedingly—in such a quantity and at such a temperature that the cooling agent, on its way inside the counter-stream through the coils of the mold, condenses in accordance with the principle of forced throughput, and is heated in the top spirals to the desired, adjustable, optimal temperature. Resulting from this in accordance with the invention is a clearly improved casting quality as compared to the state of the art, which was not foreseeable.

When starting the casting process, at comparatively low wall temperatures in the mold, an amount of cooling agent, precalibrated by the control system to the no-load running value is conveyed through the cooling coils whereby the mold wall heats up very rapidly and without condensation phenomena to the desired operating temperature. Then, with increasing casting speed, the control system differentially regulates the amount of cooling agent in continuous fashion, as a function of the rising temperature values.

The cooling hoses mentioned can be provided coiled in single-entry fashion in the case of smaller molds, or in the case of larger molds in multiple-entry fashion.

Shown in extracted fashion and schematically in FIG. 6 is a hollow ram 45 with openings 47 for discharge of the parting agent, over wich the cooling tube 13 or, if the mold is used without cooling tube, the surface of the cooling mold 7 itself is surface treated.

The desired, adjustable controling of the temperature can be achieved by the feed pump 49 shown in FIG. 2.

In certain cases, it also is advantageous to avoid extending the internally located cooling tube 13 to the top of the cooling mold 7, but rather to allow it to end at a certain distance from the top end of the cooling mold 7, then inserting a graphite ring up to the height of the mold 7.

We claim:

1. A continuous casting apparatus adapted for mounting to a crucible to receive melt from the crucible, said casting apparatus including:

a continuous casting mold adapted for mounting to a floor of a crucible in fluid communication therewith, to receive melt from said crucible for forming a continuous casting advanced in a longitudinal, downward direction; said casting mold including an inlet part and a cooling part positioned longitudinally of said inlet part;

said inlet part being substantially heat insulative, fire resistant, and resistant to attack by said melt;

said cooling part including a highly heat conductive, essentially metallic body, means forming in said cooling part an inner cooling surface for slidably contacting said casting as said casting is advanced in said downward direction, and a cooling coil through said body and encircling said inner surface; the longitudinal distance between adjacent turns of said cooling coil, and the transverse distance between said coil and said inner surface, increasing in the upward direction; and a parting agent including graphite provided at least at said cooling surface.

2. The casting apparatus of claim 1 wherein:

said means forming an inner cooling surface includes a cooling tube internally of said body and directed longitudinally through said body.

3. The casting apparatus of claim 2 wherein:

said parting agent is provided only in said cooling tube.

4. The casting apparatus of claim 2 wherein:

said cooling tube diverges upwardly from its bottom end, and extends upwardly over part of the height of said cooling part.

5. The casting apparatus of claim 2 wherein:

said cooling tube consists essentially of metallic, thermally conductive and high strength material.

6. The casting apparatus of claim 1 wherein:

said cooling part extends upwardly to terminate proximate said floor of said crucible, and said inlet part of said casting mold is disposed inside said floor.

7. The casting apparatus of claim 6 further including:

gaskets for thermally isolating said cooling part from said inlet part.

8. The casting apparatus of claim 6 including:

gaskets for thermally isolating said cooling part from said floor.

9. The casting apparatus of claim 2 wherein:

said cooling tube is circular in transverse cross-section and, in longitudinal section, has opposed upwardly diverging paraboloid sides.

10. The casting apparatus of claim 8 wherein:

said paraboloid sides have a shape which is predetermined based on the expected speed of advancement and shrinkage of said casting.

11. The casting apparatus of claim 1 including:

first and second temperature sensing elements cast in said cooling part for measuring the temperature at the upper inlet and lower outlet ends of said cooling part, respectively, to allow control of the amount of cooling agent conveyed through said cooling coil as a function of the temperatures sensed by said first and second thermal elements.

12. The casting apparatus of claim 1 wherein:

said inner cooling surface is formed of a perlitic, finely laminar alloy of cast iron including from 2 to 3.2% carbon, from 0.4 to 2.2% silicone, and 15 to 25% chromium.

13. The casting apparatus of claim 12 wherein:

said laminar alloy includes graphitically separated carbon and graphite crystals in uniformly, finely distributed form.

14. The casting apparatus of claim 2 wherein:

said cooling tube is constructed of an austenitic type of cast iron and an added parting agent including finely distributed graphite.

15. The casting apparatus of claim 1 wherein:

said inner cooling surface is roughened to form a plurality of depressions and smooth crests of elevation among said depressions, wherein said depressions are covered with said parting agent.

16. The casting apparatus of claim 14 including:

additives of preferentially high melting point carbonates, oxides and nitrides provided at least at said cooling surface with said parting agent, and selected in view of the expected composition of said casting.

17. The casting apparatus of claim 2 wherein:

said cooling tube is thin walled and consists of one of the following: stainless steel or aluminum-bronze.

* * * * *